US006646667B1

(12) United States Patent
Favre et al.

(10) Patent No.: US 6,646,667 B1
(45) Date of Patent: Nov. 11, 2003

(54) THERMAL PRINTER

(75) Inventors: Patrick Favre, Paris (FR); Laurent Brac De La Perriere, Charentay (FR)

(73) Assignee: Sagem SA, Paris (FR)

( * ) Notice: Subject to any disclaimer, the term of this patent is extended or adjusted under 35 U.S.C. 154(b) by 0 days.

(21) Appl. No.: 09/663,431

(22) Filed: Sep. 16, 2000

(30) Foreign Application Priority Data

Sep. 16, 1999 (FR) ..... 99 11569

(51) Int. Cl.[7] ..... B41J 2/325
(52) U.S. Cl. ..... 347/222
(58) Field of Search ..... 347/200, 220, 347/222, 197, 218; 400/120.16, 120; 346/139 C; 101/288

(56) References Cited

U.S. PATENT DOCUMENTS 4,507,667 A * 3/1985 Tsuboi ..... 347/197
4,750,880 A * 6/1988 Stephenson et al. ... 400/120.16
5,005,026 A * 4/1991 Sakai ..... 347/197
5,173,718 A * 12/1992 Takayama et al. ..... 346/139 C
5,366,302 A * 11/1994 Masumura et al. .... 400/120.16
5,882,126 A * 3/1999 Bowling ..... 101/288
6,053,648 A * 4/2000 Mistyurik ..... 347/197
6,118,469 A * 9/2000 Hosomi ..... 347/222

FOREIGN PATENT DOCUMENTS

| | | |
|---|---|---|
| DE | 4005810 | 8/1991 |
| EP | 0765761 | 4/1997 |
| GB | 2234713 | 2/1991 |
| JP | 02128854 | 5/1990 |
| JP | 08011385 | 1/1996 |

* cited by examiner

*Primary Examiner*—Lamson Nguyen
*Assistant Examiner*—K. Feggins
(74) *Attorney, Agent, or Firm*—Boyle Fredrickson Newholm Stein & Gratz S.C.

(57) ABSTRACT

In order to facilitate the making of thermal printers for portable payment terminals, for example, a heat sink is made. To this heat sink, there is fixed a print head comprising two protruding features, on which there abuts a pin of a paper feed roller. Furthermore, the assembly formed by the head and the heat sink is fixed to the frame of the printer by two elastic links reacting in different directions and countering the positioning of the roller. The paper feed roller is thus placed flat against the print head, thus giving homogeneous contact between the head and the paper and the efficient positioning of the roller with respect to the print head.

6 Claims, 1 Drawing Sheet

THERMAL PRINTER

BACKGROUND OF THE INVENTION

1. Field of the Invention

An object of the invention is a thermal printer. The field of the invention is that of thermal printers, and more particularly that of thermal printers contained in payment terminals for bank cards, for example. These are therefore thermal printers with a small printing width and a fixed print head. The aim of the invention is to ensure that the paper on which the printing is to be done will be supported homogeneously on the print head, and to achieve this with a device that is simpler and costs less to manufacture.

2. Description of the Prior Art

In the prior art, bank payment terminals are provided with a thermal print head having a width of about 58 mm, and comprising about 384 printing points. This amounts to a definition of 6.6 dots per millimeter. This print head is fixed to the frame of the printer by an elastic device that gives the print head mobility along one direction. The thermal paper is held against the print head by a paper feed roller. The feed roller is fixedly held to the cover of the paper-loading bin. Thus when this cover is opened to refill the printer with paper, the feed roller moves away from the print head. This leaves the user fully free to position the paper. Then, when the cover is closed again, the paper-feed roller presses the paper against the print head. In order to position the roller accurately with respect to the print head and, therefore ensure that the paper is held properly, the roller rests against a fixed stop on the frame of the printer.

FIG. 1 shows a print head 101 fixed to a frame 102 by an elastic link 103 that gives the head 101 mobility in a horizontal direction. A sheet of paper 104 is held against the head 101 by a roller 105. The roller 105 is supported on a stop 106 fixed to the frame 102. Furthermore, the roller 105 is mobile around a hinge 107.

The problem with this device is that, when it is being made, it accumulates numerous dimensional and tolerance values that must be adhered to in order to ensure that the roller 105 is accurately positioned. The dimensions relate to the frame, on the stop 106, the hinge 107 and the print head 101. Indeed, while the link 103 makes it possible to compensate for a slight defect in a horizontal positioning of the roll, it cannot compensate for a defect in the vertical positioning. The stop 106 therefore needs to be fixed precisely with respect to the frame 102. Similarly, the play of the hinge 107 should be zero. This is therefore a solution difficult to implement.

The invention resolves these problems firstly by fixedly joining the stop and the print head and, secondly by making the print head mobile in two directions. Thus, the print head corrects the positioning errors of the paper feed roller caused by poor machining or by borderline compliance with dimensional requirements, along a horizontal direction and a vertical direction.

SUMMARY OF THE INVENTION

An object of the invention therefore is a thermal printer comprising a frame, a print head, a paper feed roller, and a securing stop for the paper feed roller wherein the securing stop for the paper feed roller is rigidly fixed to the print head.

BRIEF DESCRIPTION OF THE DRAWINGS

The present invention will be understood more clearly from the following description and the appended figures.

These figures are given purely by way of an indication and in no way restrict the scope of the invention. Of these figures.

DETAILED DESCRIPTION OF AT LEAST ONE

Figure 1:
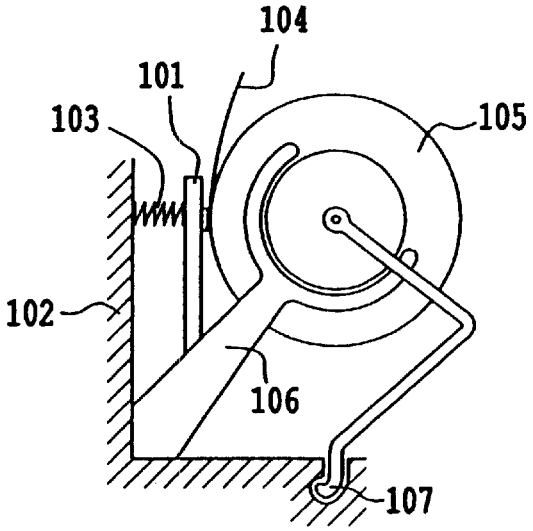
Fig. 1 (PRIOR ART)
FIG. 1 illustrates a device existing in the prior art.
Figure 2:
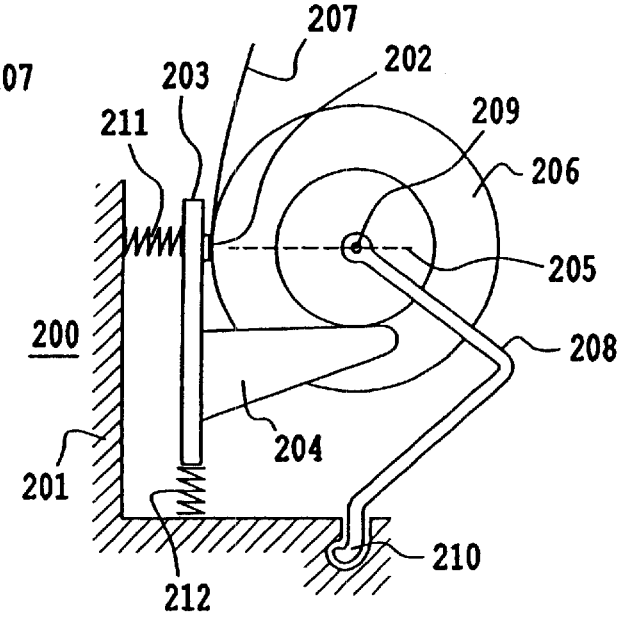
FIG. 2 illustrates a device according to the invention.

FIG. 2 shows a frame 201 of a printing device 200. The printing device 200 may be a printer or any other device that necessitates the printing of information, for example a bank payment terminal. FIG. 2 also shows a print head. This print head has a width substantially equal to that of the paper on which it must print, and it has heating elements to "burn" images into this paper. In the present example, the print head has a width of 58 mm, and comprises 384 independent heating elements. These elements form a line and may be actuated independently. This means that a line of the printed image comprises 384 pixels. The print head 202 is fixed to a heat sink 203. The heat sink 203 is a device made out of a material that dissipates the excess heat produced by the head 202. In general, a heat sink is a flat device. In the invention, the heat sink 203 has a protruding feature 204. This protruding feature 204 serves as a stop for a pin 205 of a drive roller 206 of the paper. It is also useful for dissipating the excess heat and will cool the different heating elements that form the head 202.

The head 202 is fixed to the heat sink 203 in such a way that when the pin 205 of the roller 206 is supported on the protruding feature 204, the line formed by the heating elements of the head 202 and the directrix, or axis of the pin 205 are parallel (see dashed line in FIG. 2), and there is tangency between the head 202 and the surface of the roller 206. Thus, when a sheet of paper 207 is positioned between the head 202 and the roller 206, the sheet 207 can be driven by the roller 206. Furthermore, since there is tangency between the roller 206 and the head 202 the sheet 207 can be printed since it is placed flat on the print head 202 by the roller 206.

The pin 205 is fixed to an arm 208 by a pivot link 209. The pin 205 and the roller 206 may therefore have a rotational motion about the pivot link 209. The arm 208 is fixed to the frame 201 by a hinge 210. The link between the pin 205 and the arm 208 may be slightly floating. When the arm 208 is pivoted about the hinge 210, the roller 206 is moved away from the head 202. This releases the paper 207. This also gives access to a compartment of the device into which the printer device is incorporated. This compartment contains the stock of paper. The arm 208 is in an open position, when the roller 206 is as distant as possible from the head 202. The arm 202 is in a closed position when there is a tangency between the roller 206 and the head 202.

Figure 4:
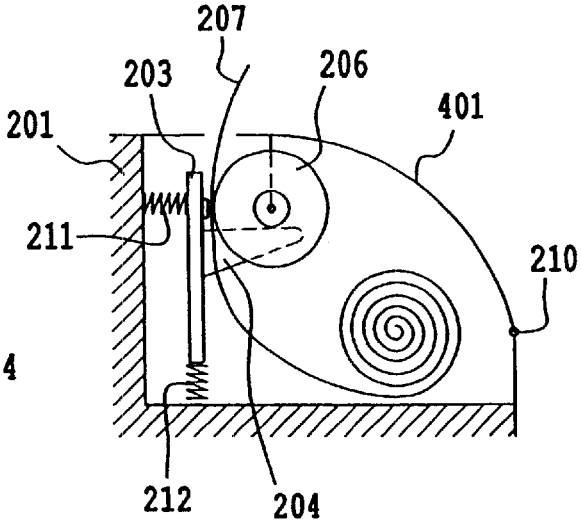
FIG. 4 illustrates a device according to the invention with the cover closed.

FIG. 4 shows that, as a rule, the arm 208 is a cover 401. The roller 206 and the cover 401 are therefore joined in a rotational motion about the axis of the hinge 210. When the cover is in closed position, there is a locking device that is not shown. This locking device limits the travel of the cover about the hinge 210. When the cover 401 is in a closed position, the pin 205 is supported on the stop 204 and the roller 206 is supported on the head 202. In order that this result may be obtained, the heat sink 203 is fixed to the frame 201 by a spring 211 which may be compressed in a horizontal direction and by a spring 212 which may be compressed in a vertical direction. In this description, the horizontal direction is defined when the instrument comprising the device according to the invention is placed flat on a table, in a normal position designed for its operation by its manufacturer. In practice, it is enough that the directions of compression of the springs 211 and 212 should be not parallel and that they should counter the positioning of the roller 206. The right positioning of the roller 206 with respect to the head 202 is therefore provided by an efficient structure of the stop 204.

Figure 3:
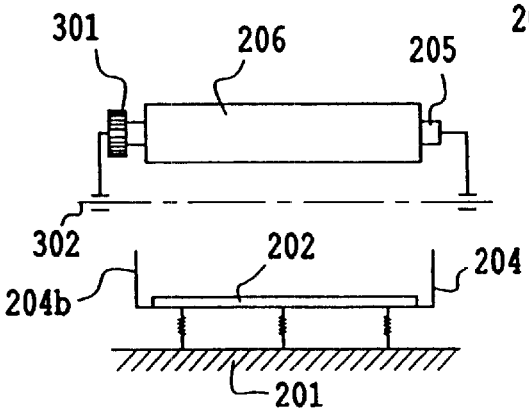
FIG. 3 illustrates a device according to the invention with the cover open.

FIG. 3 illustrates the fact that FIG. 2 is a side view. FIG. 3 shows that there is a protruding feature on which the pin 205 abuts on either side of the head 202. There is therefore a protruding feature 204 and a protruding feature 204*b*. The pin 205 rests both on the stop 204 and on the stop 204*b*.

FIG. 3 also shows that the pin 205 is fixedly joined, for example to a gear mechanism 301. It is through this gear mechanism 301 that the roller 206 can be driven rotationally and therefore drive the paper to make it move past the head 202. The assembly formed by the pin 205, the roller 206 and the gear mechanism 301 is rotationally mobile about an axis 302 parallel to the head 202. This enables the positioning of the roller 206 flat against the head 202, or the releasing of an access to a compartment in which the stock of printer paper is kept.

For the rotational driving of the roller 206, one alternative is that the gear mechanism 301 will get meshed with a gear mechanism fixed to the frame 201. In this case, the gear mechanism fixed to the frame 201 is driven rotationally by a motor contained in the device. The other alternative is that the gear mechanism 301 is meshed with a device contained in the cover 401. The latter approach removes the need for means to make the gear mechanism 301 mesh properly with a gear mechanism that might be fixed to the frame 201. Indeed, in the latter approach, the device used to drive the roller 206 rotationally is totally joined, in its motion about the axis 302, with the pin 205 and the roller 206. This approach eliminates the problems linked to the relative positioning of the two gear mechanisms which have to mesh properly.

What is claimed is:

1. A thermal printer comprising:

a frame;

a heat sink with a pair of outwardly extending heat sink stops;

a print head fixed to the heat sink;

a paper feed roller upon which paper is disposed during printing, the roller having a pin extending outwardly from each end with one pin resting on one of the stops and the other pin resting on the other one of the stops; and an arm that is attached to the frame, wherein the arm and pin are coupled by a floating link.

2. A thermal print of claim 1 further comprising a hinge, wherein when the arm is pivoted about the hinge, the roller moves away from the print head to allow release of a roll of paper received on the roller.

3. A thermal printer according to claim 2 wherein the heat sink is fixedly joined to the frame via springs acting in at least two different directions.

4. A thermal printer according to claim 3 wherein at least one of the springs counters the positioning of the paper feed roller.

5. A thermal printer according to claim 1 wherein the heat sink is fixedly joined to the frame via springs acting in at least two different directions.

6. A thermal printer according to claim 5 wherein at least one of the springs counters the positioning of the paper feed roller.

* * * * *